US005158601A

United States Patent [19]

Fujiki et al.

[11] Patent Number: 5,158,601

[45] Date of Patent: Oct. 27, 1992

[54] WEAR-RESISTANT IRON-BASED SINTERED ALLOY AND METHOD

[75] Inventors: Akira Fujiki; Kenzo Morita, both of Kanagawa; Akiyoshi Ishibashi, Saitama; Kazutoshi Takemura, Saitama, all of Japan

[73] Assignees: Nissan Motor Co., Ltd., Kanagawa; Kabushiki Kaisha Riken, Tokyo, both of Japan

[21] Appl. No.: 831,925

[22] Filed: Feb. 6, 1992

[30] Foreign Application Priority Data

Feb. 14, 1991 [JP] Japan ..... 3-40862

[51] Int. Cl.[5] ..... G22F 9/00

[52] U.S. Cl. ..... 75/246; 419/29

[58] Field of Search ..... 75/246; 419/29

[56] References Cited

U.S. PATENT DOCUMENTS 4,437,890 3/1989 Hayasaka et al. ..... 75/244

4,648,903 3/1987 Ikenoue et al. ..... 75/246

FOREIGN PATENT DOCUMENTS 2-104636 4/1990 Japan .

3-47591 2/1991 Japan .

*Primary Examiner*—Stephen J. Lechert, Jr.

[57] ABSTRACT

In a method for producing by a powder-metallurgical method a wear-resistant iron-based sintered alloy, which essentially consists of from 0.3 to 2.5% by weight of C, from 1 to 8% of Cu, from 3 to 14% of at least one element selected from the group consisting of Cr, Mo, W, V, Nb, and Ta, and Fe and the unavoidable impurities in balance, and which has a micro-structure such that a majority of the alloying elements are uniformly dissolved as solutes of the iron matrix and fine Cu phase is uniformly dispersed, a composite powder which consists of iron or iron alloy and Cu which is present mainly on the surface of the composite powder is used in the raw-material powder.

8 Claims, 2 Drawing Sheets

WEAR-RESISTANT IRON-BASED SINTERED ALLOY AND METHOD

BACKGROUND OF INVENTION

1. Field of Invention

The present invention is related to a method for producing a wear-resistant iron-based sintered alloy used, for example, for a valve seat of an internal combustion engine.

2. Description of Related Arts

Mo, W, V, Nb, Ta and the like are the alloying elements used as the additives of an iron-based sintered alloy used for the valve seat and the like. In most cases, they are in the form of hard particles, such as ferro-alloy, carbide, and composite alloys, and are mixed in the raw-material powder. The hard particles are therefore dispersed in the sintered alloy. In the case of the use of hard particles, since Cr, Mo, W. V, Nb and Ta are hard to diffuse deeply in the iron matrix, not the entire matrix and only the circumference of the hard particles is solution strengthened. The matrix is therefore mainly dispersion-strengthened. In other words, it cannot be expected that Cr, Mo, W, V, Nb and Ta will be dissolved and alloyed with the entire matrix.

On the other hand, Cu is easy to diffuse in the iron matrix and noticeably strengthens the iron matrix due to fine solution and precipitation therein. The Cu, which is finely precipitated in a valve seat, is effective for buffering the impact on the valve seat, which is struck by the opposed material, i.e., the valve. The Cu, which is a soft minority phase of the valve seat, is effective for mitigating its attacking action against the valve, when the valve seat and valve are subjected to wear under tapping. The present applicants filed Japanese Patent Applications Nos. Showa 63-255363 and Heisei 1-183073. In these patent applications, Cu is once dissolved as a solute element of the matrix during the production process of the sintered alloy and is then uniformly precipitated by heat treatment.

The ordinary Cu powders, namely the atomized and crushed Cu powders, are used as the Cu source in the above described method for producing the sintered alloy. When the ordinary Cu powders are mixed in the raw-material powder, the Cu particles coagulate to form coarse Cu lumps from a few tens to a few hundreds μm in size. When the Cu is then dissolved during the sintering process, coarse pores may be formed at the portions where the Cu particles have been present.

Along with recent enhancement of the performance of the automobile engines, the load applied to the sliding surface of a valve seat, is subsequently increasing. This is one of the applications of the above described wear-resistant iron-based sintered alloy. It becomes, therefore, necessary to highly densify and hence increase the strength of such an alloy. Meanwhile, a valve seat must be made so thin as to enhance the cooling efficiency and to lessen the weight thereof. The necessity of the strength-enhancement therefore arises.

SUMMARY OF THE INVENTION

It is therefore an object of the present invention to provide a wear-resistant iron-based sintered alloy having enhanced strength and wear-resistance, and to provide a method for producing such alloy by means of refining the pores, which are formed when the Cu powder is dissolved into the iron matrix, and which are found in portions where the Cu powder has disappeared.

In accordance with the present invention, there is provided a method for producing a wear-resistant iron-based sintered alloy, characterized in that the raw-material powder, which comprises the composite iron-copper powder or composite iron-alloy copper powder, on which surface the Cu is present, is compacted and sintered, and, a sintered compact is subjected to precipitation of the Cu phase.

More specifically, the present invention is related to a method for producing a wear-resistant iron-based sintered alloy, which consists of from 0.3 to 2.5% by weight of C, from 1 to 8% of Cu, from 3 to 14% of at least one element selected from the group consisting of Cr, Mo, W, V, Nb, and Ta, and Fe and the unavoidable impurities in balance, and which has a microstructure such that a majority of the alloying elements are uniformly dissolved as solutes of the iron matrix and fine Cu phase is uniformly dispersed. The method according to the present invention comprises: preparing a composite powder which consists of iron or iron alloy and Cu which is present mainly on the surface of the composite powder; compacting a raw-material powder which comprises the composite powder; sintering a green compact; and subjecting a sintered compact to precipitation of the Cu phase.

A wear-resistant iron-based sintered alloy provided by the present invention, essentially consists of from 0.3 to 2.5% by weight of C, from 1 to 8% of Cu, from 3 to 14% of at least one element selected from the group consisting of Cr, Mo, W, V, Nb and Ta, and Fe and unavoidable impurities in balance, which has a microstructure that a majority of the alloying elements is dissolved in the iron matrix as solutes of the iron matrix, nodular carbides and Cu precipitates are dispersed in the iron matrix, characterized in that pores formed due to solution of the Cu into the iron matrix are substantially as fine as the nodular carbides.

Figure 1:
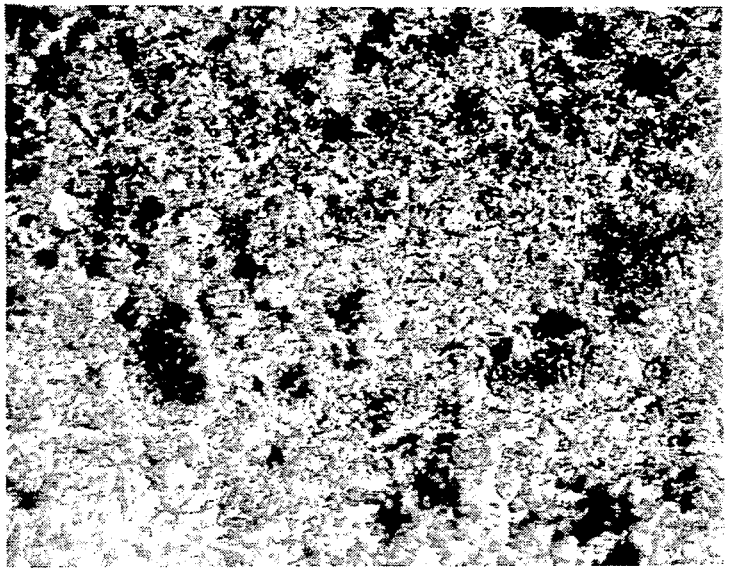
FIG. 1 is a photograph (magnification ×200) showing a metal micro-structure of the Inventive Material 2.
Figure 2:
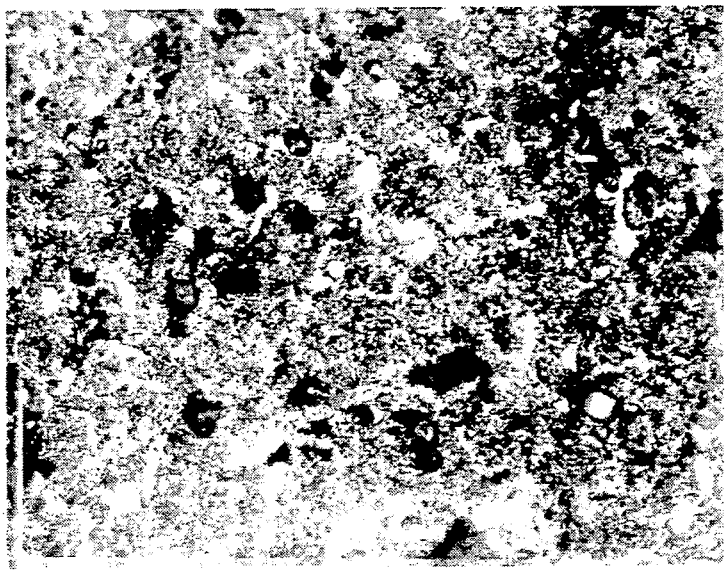
FIG. 2 is a photograph (magnification ×200) showing a metal micro-structure of the Conventional Material 1.
Figure 3:
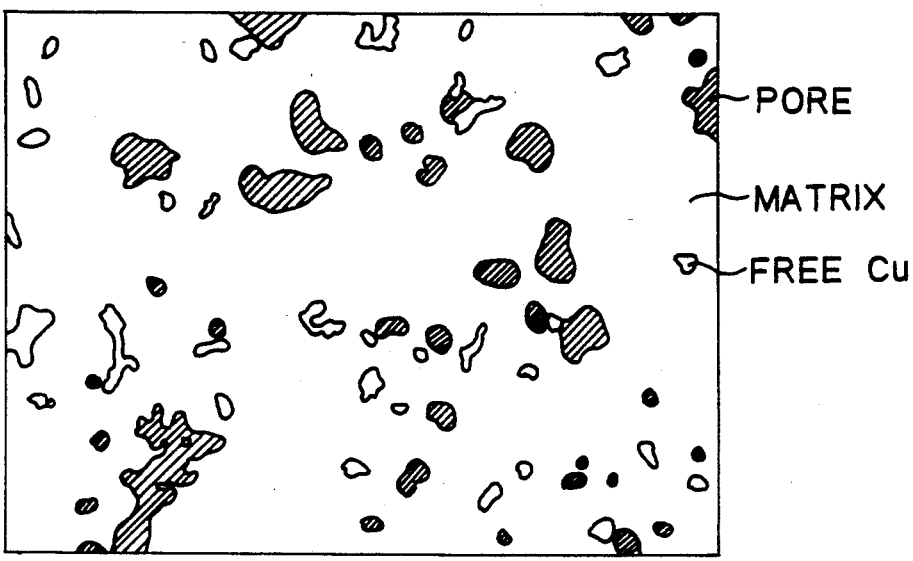
FIG. 3 illustrates the morphology of the Cu phase and pores of the Conventional Material 1 by the blank white pattern and the hatching pattern, respectively.
Figure 4:
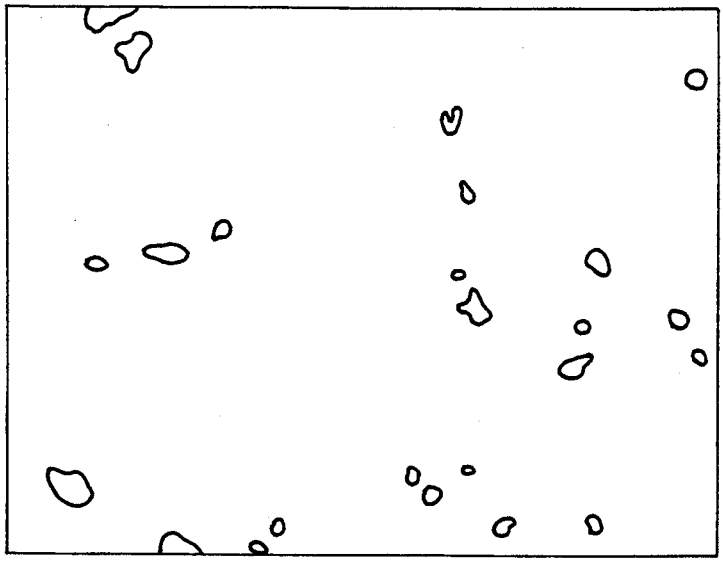
FIG. 4 is a drawing similar to FIG. 3, showing the Inventive Material 2.

The present invention is described in detail hereinafter.

The composition of the iron-based sintered alloy is further described.

Carbon is a solute element which is dissolved in the iron matrix to enhance its strength. Carbon also reacts with an alloying element(s) to form carbides. The target carbon content is in the range from the eutectoid to hyper eutectoid composition which is somewhat more C rich than the eutectoid. In addition, the carbon content is determined necessarily in relation with the alloying elements, such as Cr, Mo, W, V, Nb, and Ta so that neither ferrite nor coarse carbides are formed due to addition of the alloying elements. The carbon content is therefore determined taking into consideration the Cr, Mo, W, V, Nb, and Ta contents described hereinbelow in the range of from 0.3 to 2.5%. When the carbon content is extremely lower than the eutectoid composition, ferrite, which is a soft phase, is disadvantageously formed to impair the wear-resistance. On the other hand, when the carbon content is so high as to form coarse carbide, the sintered compact disadvantageously becomes hard-to-work and embrittles. Desirably, neither ferrite nor coarse carbides are formed. However, actually, the carbon content of the sintered compact is influenced by the oxygen content of the raw-material powder, the sintering atmosphere and the like, and is therefore difficult to control strictly. A ferrite and carbide content of 5% or less of each is therefore allowable.

Cr, Mo and W belong to VI group and V, Nb and Ta belong to V group of the Periodic Table. They are solute elements which are dissolved in the iron matrix and enhance its strength and heat-resistance. They also react with carbon to form carbides which enhance the wear-resistance. When the content of these elements is less than 3%, the wear-resistance is not enhanced satisfactorily. On the other hand, when the content of these elements exceeds 14%, disadvantageous results occur; the compactibility of the powder is lessened and the material is hardened and embrittles. The content of Cr, Mo, W, V, Nb and Ta (total content in the case of two or more elements) is therefore from 3 to 14%. These elements have similar effects of enhancing the wear-resistance and can therefore be added singly or several elements together.

If Cu is added in an amount of less than 1%, virtually no Cu phase is precipitated. On the other hand, when the Cu content exceeds 8%, the Cu content exceeds the solubility of Cu in the Fe-X alloy at the sintering temperature. Cu is therefore disadvantageously distributed in the form of a network between the particles of the Fe-X alloy due to the sintering. The Cu content must therefore be in the range of from 1 to 8%.

In addition to the above elements, Co, B and the like may be auxiliary used to enhance the strength of the matrix. However, in order to form the fine Cu precipitation phase, Ni or the like, which increases the Cu solubility, should be limited to 0.1% at the highest.

The method according to the present invention for producing the sintered alloy is now described.

The method for preparing the Cu composite powder may be any one of: mechanical alloying; plating; partial alloying; and a method in which Cu is dissolved as a solute element in the raw-material powder during its atomizing and is then preciptated on the surface of the powder by subsequent heat treatment. Fine Cu in the order of micron meters is attached to the powder of the main raw-material, such as the iron powder, iron-alloy powder and non-ferrour alloy powder, e.g., Mo powder. The fine form of Cu is thus maintained until its dissolving into the iron matrix. The fine form of Cu is such that the pores generated due to the disappearance of Cu are no minute that they disappear due to shrinkage of the mother material or are left as fine as nodular carbides.

(1) Mechanical Alloying Method

The Cu Powder and the iron powder or the like are together subjected to the mechanical alloying to provide the raw-material powder, in which Cu is finely attached mainly on the surface of the iron particles. The iron particles are finely divided and then again cooperated according to the ordinary mechanical alloying method. Part of Cu powder is incorporated in the iron particles being bonded. The thus incorporated Cu forms a fine Cu dispersion phase. Since the Cu, which is attached mainly on the surface of the iron particles or the like, is used in the present invention, the mechanical alloying time according to the present invention may be shorter than the ordinary mechanical alloying which attains the dispersion as described above.

Cr, Mo, W, V, Nb and/or Ta are desirably uniformly dissolved in the matrix of the sintered alloy. The atomized Fe-X (X is Cr, Mo, W, V, Nb and/or Ta) alloy powder, in which a part of X is uniformly dissolved, is preferably used as the raw-material powder. The other part of X may be in the form of fine metallic powder under 325 mesh, which is the atomized Fe-X powder. The powders, which are subjected to the mechanical allowing, are all of the Cu powder and a part or all of the Fe and Fe-X powder. The metallic Mo, W, V and Nb powder may or may not be subjected to the mechanical alloying.

(2) Plating Method

Cu can be deposited on the surface of the iron powder by means of electro-less plating so as to form the Fe-Cu composite powder.

(3) Partial Alloying Method

Cu particles are deposited on the surface of the iron or iron-alloy particles by the methods (1), (2) described above. Cu can also be deposited by the vapor deposition method of Cu. Subsequently, heat-treatment is carried out to partially alloy the deposited Cu into the iron particles and the like so as to form a composite Cu-Fe powder, on whose surface the unalloyed Cu is present. If all of the deposited Cu is alloyed, the compactibility of the powder is lessened. It is therefore important that only a part of the deposited Cu is alloyed and the majority of the deposited Cu is present on the surface of the composite powder.

(4) Atomizing Method

The iron powder containing Cu is produced by water atomizing and is subsequently heat treated at a temperature of from for example 400° to 700° C. so as to precipitate the Cu within the particles and also on the surface of the particles.

The raw materials prepared as described above are mixed, compacted and sintered according to the powder metallurgical method. Regarding the sintering, it is necessary to once completely dissolve Cu into the matrix of the Fe-X alloy, so as to subsequently precipitate fine Cu phase after the sintering. When the sintering temperature is less than 1100° C., the post-sintering strength is too low to attain satisfactory wear-resistance, and the solubility of Cu in the matrix of Fe-X alloy is low. On the other hand, when the sintering temperature is more than 1200° C., disadvantageously, a large amount of the liquid phase is formed and the carbides are coarsened. The sintering temperature is therefore preferably from 1100° to 1200° C.

The post-sintering cooling needs to be carried out at a speed approximately equal to or higher than the gas-forced cooling, so as to finely precipitate the Cu phase subsequent to the sintering and to prevent precipitation of coarse Cu phase during the post-sintering cooling. When the post-sintering cooling becomes slower than the desirable speed, the solution heat-treatment may be subsequently carried out.

After sintering, tempering is carried out at a temperature of from 400° to 700° C. so as to finely and uniformly precipitate the Cu phase.

The present invention is described in detail with reference to the examples and the comparative examples.

EXAMPLE 1

The mechanical alloying, plating, and partial alloying were carried out as follows.

(1) Mechanical Alloying

Fe-5% Mo alloy was subjected to water-atomizing. The resultant iron powder had a particle size with a peak in the range of from 50 to 200 mesh. 5% of Mo was uniformly dissolved in the iron powder. Electrolytic Cu powder with a particle size under 325 mesh was weighed to provide 5% based on the total of the powders. The powders were mixed by a ball mill under Ar atmosphere for 20 minutes. Cu powder was attached to the surface of the iron powder.

(2) Plating Method

Fe-5% Mo alloy having peak particle size in the range of from 50 to 200 mesh and containing 5% of Mo as a uniform solute element was dipped in the saturated copper sulfate solution. The electroless plating was carried out for approximately 2 hours in the saturated copper sulfate solution. After the treatment, the plated iron powder was separated from the solution and then dried. The plated iron powder was then milled with a ball mill so as to adjust the particle size.

(3) Partial Alloying Method

After treatment (1) or (2), the powders were heated at 900° C. for 1 hour under the hydrogen-gas atmosphere, so as to partially alloy the Fe-5% Mo with Cu. After heat treatment for alloying, the powder was milled with a ball mill to adjust the particle size.

(4) Atomizing Method

The fe-5% Mo-5% Cu alloy was subjected to the water atomizing method to obtain the iron powder. The resultant iron powder was heat treated at 400° C.-700° C. so as to precipitate the Cu on the surface of the iron particles. The so-treated powder contained 5% of Mo as the uniform solute element and had Cu attached on the surface thereof. This powder was mixed with 1.5% of graphite powder and 0.6% of zinc stearate as the lubricant which facilitates withdrawal of a green compact from a die at the die compacting. The mixed powders were compacted at a pressure of 7 t/cm$^2$ to obtain a green compact. The green compact was de-waxed at 650° C. for 1 hour. The sintering was then carried out at 1150° C. for 1 hour. After the sintering, the furnace cooling was carried out until a temperature of 900° C. was reached, and then $N_2$ gas-forced cooling was initiated at 900° C.

Tempering was then carried out at 550° C. for 1 hour. As a result, a fine Cu phase was precipitated.

The test pieces produced by the process as described above had a dimension of 46 mm in outer diameter, 30 mm in inner diameter and 7.5 mm in height. The test pieces were subjected to measurement of density and radial crushing strength. The results are given in Table 1.

The methods for adding Cu in Table 1 are: adding Cu powder in the compactive example; mechanical alloying in Inventive Material 1; plating in Inventive Material 2; partial alloying in Inventive Material 3; and atomizing in Inventive Material 4.

TABLE 1

| Test Pieces | Chemical Composition (weight %) C | Mo | Cu | Fe | Density (g/cm$^3$) | Hardness (HRB) | Radial Crushing Strength (kg/cm$^3$) |
|---|---|---|---|---|---|---|---|
| Comparative | 1.11 | 5.00 | 4.60 | bal | 7.14 | 100.3 | 108.7 |

TABLE 1-continued

| Test Pieces | Chemical Composition (weight %) C | Mo | Cu | Fe | Density (g/cm$^3$) | Hardness (HRB) | Radial Crushing Strength (kg/cm$^3$) |
|---|---|---|---|---|---|---|---|
| Material 1 | | | | | | | |
| Inventive Material 1 | 1.15 | 4.87 | 5.0 | bal | 7.20 | 107.7 | 114.3 |
| Inventive Material 2 | 1.05 | 4.94 | 5.18 | bal | 7.13 | 102.9 | 109.9 |
| Inventive Material 3 | 1.15 | 4.97 | 4.85 | bal | 7.19 | 102.3 | 119.0 |
| Inventive Material 4 | 1.14 | 5.09 | 4.57 | bal | 7.07 | 103.6 | 114.9 |

As is apparent from Table 1, the strength of the inventive materials is higher than that of the comparative material.

EXAMPLE 2

The test pieces having the compositions as given in Table 2 were produced and tested by the method as described in Example 1. The results are given in Table 2.

TABLE 2

| Test Pieces | Chemical Composition (weight %) C | Mo | Cu | Fe | Density (g/cm$^3$) | Hardness (HRB) | Radial Crushing Strength (kg/cm$^3$) |
|---|---|---|---|---|---|---|---|
| Comparative Material 2 | 1.11 | 5.00 | 4.60 | bal | 7.14 | 100.3 | 108.7 |
| Inventive Material 5 | 1.15 | 4.97 | 4.85 | bal | 7.19 | 102.3 | 119.0 |
| Comparative Material 3 | 1.15 | 4.90 | 7.50 | bal | 7.16 | 98.5 | 102.8 |
| Inventive Material 6 | 1.16 | 4.86 | 7.30 | bal | 7.30 | 102.7 | 118.3 |

The partial alloying material was used to add Cu to the Inventive Materials 2 and 3.

As is apparent from Table 2, the strength of the inventive materials is higher than that of the comparative material.

The structure of the inventive and comparative material is described by way of the drawings.

We claim:

1. A method for producing a wear-resistant iron-based sintered alloy, which essentially consists of from 0.3 to 2.5% by weight of C, from 1 to 8% of Cu, from 3 to 14% of at least one alloying element selected from the group consisting of Cr, Mo, W, V, Nb, and Ta, and Fe and the unavoidable impurities in balance, and which has a micro-structure such that a majority of the alloying element(s) are uniformly dissolved as solutes of the iron matrix and Cu phase is uniformly dispersed, said method comprising: preparing a composite powder which consists of iron or iron alloy and Cu which is present mainly on the surface of the composite powder; compacting a raw-material powder which comprises the composite powder; sintering a green compact; and subjecting a sintered compact to precipitation of Cu phase.

2. A method for producing a wear-resistant iron-based sintered alloy according to claim 1, wherein the composite powder is prepared by mechanical alloying of copper and an iron powder or an iron-alloy powder which essentially consists of iron and at least one element selected from the group consisting of Cr, Mo, W, V, Nb and Ta.

3. A method for producing a wear-resistant iron-based sintered alloy according to claim 1, wherein the composite powder is prepared by plating copper on an iron powder or an iron-alloy powder, which essentially consists of iron and at least one element selected from the group consisting of Cr, Mo, W, V, Nb and Ta.

4. A method for producing a wear-resistant iron-based sintered alloy according to claim 1, wherein the composite powder is prepared by the method according to claim 1 or 2 and subsequently partially alloying a portion of the copper deposited on said iron-powder or iron-alloy powder with said iron or iron alloy.

5. A method for producing a wear-resistant iron-based sintered alloy according to claim 1, wherein the composite powder is prepared by atomizing and subsequent precipitation heat-treatment.

6. A method for producing a wear-resistant iron-based sintered alloy according to claim 1, 2, 3, 4 or 5, wherein the sintering is carried out at a temperature of from 1100° to 1200° C.

7. A method for producing a wear-resistant iron-based sintered alloy according to claim 1, wherein the precipitation of the Cu phase is carried out by tempering at a temperature of from 400° to 700° C.

8. A wear-resistant iron-based sintered alloy, which essentially consists of from 0.3 to 2.5% by weight of C, from 1 to 8% of Cu, from 3 to 14% of at least one alloying element selected from the group consisting of Cr, Mo, W, V, Nb and Ta, and Fe and unavoidable impurities in balance, which has a micro-structure that a majority of the alloying element(s) is dissolved in the iron matrix as solutes of the iron matrix, nodular carbides and Cu precipitates are dispersed in the iron matrix, wherein the pores formed due to solution of the Cu into the iron matrix are substantially as fine as the nodular carbides.

* * * * *